US009907418B2

(12) United States Patent
Dunwood

(10) Patent No.: US 9,907,418 B2
(45) Date of Patent: Mar. 6, 2018

(54) UNITIZED BED COVERING ASSEMBLY

(71) Applicant: Laura Dunwood, Oakland, CA (US)

(72) Inventor: Laura Dunwood, Oakland, CA (US)

( * ) Notice: Subject to any disclaimer, the term of this patent is extended or adjusted under 35 U.S.C. 154(b) by 0 days.

(21) Appl. No.: 14/856,348

(22) Filed: Sep. 16, 2015

(65) Prior Publication Data

US 2016/0100700 A1 Apr. 14, 2016

Related U.S. Application Data

(60) Provisional application No. 62/061,940, filed on Oct. 9, 2014.

(51) Int. Cl.
*A47G 9/02* (2006.01)

(52) U.S. Cl.
CPC ..... *A47G 9/02* (2013.01); *A47G 9/0207* (2013.01); *A47G 9/0215* (2013.01); *A47G 9/0223* (2013.01); *A47G 9/0238* (2013.01); *A47G 9/0246* (2013.01); *A47G 9/0261* (2013.01)

(58) Field of Classification Search
CPC ..... A47G 9/02; A47G 9/0207; A47G 9/0223; A47G 9/0238; A47G 9/0246; A47G 9/0261; A47G 9/0215; A47G 9/086; A47G 9/062; A47G 9/1036
See application file for complete search history.

(56) References Cited

U.S. PATENT DOCUMENTS 5,092,010 A * 3/1992 Wong ..... A47G 9/0284 5/493
5,146,634 A * 9/1992 Hunt ..... A47G 9/0207 5/486
6,044,503 A * 4/2000 McClendon ..... A47G 9/02 5/482
6,088,852 A * 7/2000 Quandt ..... A47G 9/02 5/482
6,243,896 B1 * 6/2001 Osuna ..... A47G 9/0207 5/482
7,086,102 B1 * 8/2006 Frazier ..... A47G 9/02 5/494
7,487,561 B2 * 2/2009 Ho ..... A47G 9/02 5/482
9,149,136 B2 * 10/2015 Mikesell ..... A47G 9/02
2003/0135924 A1 * 7/2003 Chuang ..... A47G 9/0261 5/413 R
2009/0165205 A1 * 7/2009 Hennessy ..... A45F 3/22 5/122
2010/0050341 A1 * 3/2010 Tepper ..... A47G 9/0261 5/488
2011/0314605 A1 * 12/2011 Deguchi ..... A47G 9/0261 5/501

* cited by examiner

*Primary Examiner* — David E Sosnowski
*Assistant Examiner* — Morgan McClure
(74) *Attorney, Agent, or Firm* — GSS Law Group

(57) ABSTRACT

A fitted bottom sheet is formed with opposing pockets adapted to receive the head end and foot end of a mattress or cot. A top covering assembly including a top covering, a heat-reflecting sheet, and a top sheet attaches securely to the foot end of the fitted bottom sheet. The top covering assembly and fitted bottom sheet may be installed simultaneously as an integral unit on a cot or mattress. The top covering assembly may be formed with a pocket for receiving additional thermal insulation such as another blanket. Embodiments may be securely and neatly placed on rectangular mattresses, nonrectangular mattresses, and bedding without mattresses such as folding camp cots.

11 Claims, 10 Drawing Sheets

Section A-A

Section B-B

UNITIZED BED COVERING ASSEMBLY

CROSS REFERENCE TO RELATED APPLICATIONS

This application claims the benefit of U.S. Provisional Application No. 62/061,940, filed Oct. 9, 2014, titled "Unitized Bed Cloths Assembly", incorporated herein by reference in its entirety.

FIELD OF THE INVENTION

Embodiments are related to sheets and blankets for disposition on a bed, cot, or berth.

BACKGROUND

A comfortable bed for a person to sleep in may be arranged with a bottom sheet on top of a mattress or cushion, a top sheet over the bottom sheet, and a blanket over the top sheet. A bedspread may be placed over the blanket for additional warmth or for a decorative appearance. Bedding may be held neatly in place by folding and tucking sheets and blankets under the bottom side of the mattress to prevent sheets and blankets from being loosened or pulled away from the mattress by a person's movements while resting between the sheets. A fitted bottom sheet having elasticized corners to grip the corners of a rectangular mattress may prevent the bottom sheet from being pulled away from the mattress, but the top sheet and blanket may still be disarranged by a person's movements.

Some people don't sleep well unless their bedding is neatly arranged. However, arranging sheets and blankets to be held securely and neatly on a mattress takes time and practice. Some people may never master the skill of making a neat bed. Others may not take the time to make a neat bed every day. Some beds have a shape and/or dimensions which may interfere with the secure placement of elasticized sheets and other layers of bedding. Or, the location of a bed in a room or sleeping compartment may make it difficult to reach all sides of the bed to make the bed neatly. Conventional bedding, that is, bedding with separate sheets and blankets, may be difficult to arrange securely and neatly on a mattress which is not rectangular. Furthermore, fitted bottom sheets, flat top sheets, and blankets may be difficult to secure to cots and other forms of bedding having a thin sleeping cushion or no mattress or cushion.

SUMMARY

An example of an apparatus in accord with an embodiment includes a fitted sheet having a first mattress pocket at a foot end and a second mattress pocket at a head end opposite the foot end. The apparatus further includes a top covering assembly attached to the fitted sheet near the foot end of the fitted sheet. The top covering assembly includes a top sheet assembly and a top cover fixed to the top sheet assembly along a right side of the top cover and along a left side of the top cover. The top sheet assembly includes a top sheet and a heat-reflecting sheet fixed to the top sheet. The top covering assembly further includes a first fastener detachably coupling the top sheet assembly to the top cover near the head end; and a second fastener detachably coupling the top sheet assembly to the top cover near the foot end.

Another example of an apparatus in accord with an embodiment includes a heat-reflecting sheet made from a polymer sheet with a metallic coating; a top sheet made from a fabric and joined to the heat-reflecting sheet transversely across a head end of the top sheet and transversely across a foot end of the top sheet; and a top cover made from a fabric and joined to the top sheet near an edge of the left side and near an edge of the right side of the top sheet. The apparatus further includes a first piece of hook-and-loop fastener material attached to the heat-reflecting sheet near the head end; a second piece of hook-and-loop fastener material attached to the top cover near the head end and disposed to engage with the first piece of hook-and-loop fastener material; a third piece of hook-and-loop fastener material attached to the heat-reflecting sheet near the foot end; a fourth piece of hook-and-loop fastener material attached to the top cover near the foot end and disposed to engage with the third piece of hook-and-loop fastener material; and a fitted sheet. The fitted sheet includes a foot-end mattress pocket shaped to extend transversely across a width dimension of a foot end of a mattress and further shaped to receive the foot end of the mattress with a sliding fit; a head-end mattress pocket opposite the foot-end mattress pocket, the head-end mattress pocket shaped to extend transversely across the width dimension of a head end of the mattress and further shaped to receive the head end of the mattress with a sliding fit; a first side panel attached to the foot-end mattress pocket and to the head-end mattress pocket and shaped to cover a left side of the mattress; and a second side panel attached to the foot-end mattress pocket and to the head-end mattress pocket and shaped to cover a right side of the mattress. The example of an apparatus further includes a fifth piece of hook-and-loop fastener material disposed transversely across the foot end of the foot-end mattress pocket; and a sixth piece of hook-and-loop fastener material attached transversely across a bottom side of the top sheet near the foot end and disposed to engage with the fifth piece of hook-and-loop fastener material. An opening into the foot-end mattress pocket for receiving the foot end of the mattress faces an opening into the head-end mattress pocket for receiving the head end of the mattress.

BRIEF DESCRIPTION OF THE DRAWINGS

FIG. 4 also represents a view toward the left side of the example of a mattress from FIG. 3. (PRIOR ART)

FIG. 5 also represents a view toward the head end of the example of a mattress from FIGS. 3-4. (PRIOR ART)

DESCRIPTION

Embodiments comprise sheets and a blanket attached to one another for neatly, securely, and quickly covering a mattress, cushion, cot, bunk, or berth. Embodiments may be easily adapted to most mattress shapes, including nonrectangular mattresses, and may be used with beds such as folding camping cots having a flexible sheet stretched across a frame in place of a mattress. A minimum of adjustment is needed after an embodiment is placed on a mattress or cot to make a bed with a smooth, unwrinkled, neat appearance.

In contrast to conventional bed coverings using separate fitted sheets, flat sheets, and blankets folded and tucked around the corners and bottom side of a mattress, embodiments may be installed on a bed quickly and with a consistently neat appearance even by persons with little prior instruction. Unlike conventional bed coverings, the layers of bedding in an embodiment will not pull away from a mattress far enough to detach the bedding from the mattress while a person is in the bed, even when the person moves about vigorously. Whereas conventional bed coverings may require considerable mobility and dexterity to make a bed with sheets and blankets neatly and securely folded under and around a mattress, embodiments are well suited for use by children and by adults with below-average dexterity or little time for making up a bed by conventional methods.

An embodiment provides a set of blankets and sheets for one bed for a person. Unlike conventional bedding using fitted sheets with elasticized corners, embodiments may be quickly and easily folded into compact flat packs for easy storage and distribution. Embodiments may be advantageous for distribution following an emergency such as a natural disaster or for efficiently distributing complete sets of clean bedding to drivers in long-haul truck fleets, participants in extended group camping experiences such as "summer camp", providing clean bedding to emergency responders such as forest service firefighters, providing sanitized bedding for railway passengers or stranded airline passengers, and so on. Sheets and blankets in an embodiment may optionally be made from very low cost materials such as paper and plastic sheeting, possibly providing disposable bedding that need not be washed. Low cost unitized bedding may find use in a field hospital, emergency shelter, airport, or other locations where a large number of people may need to be accommodated with little advance notice.

Figure 1:
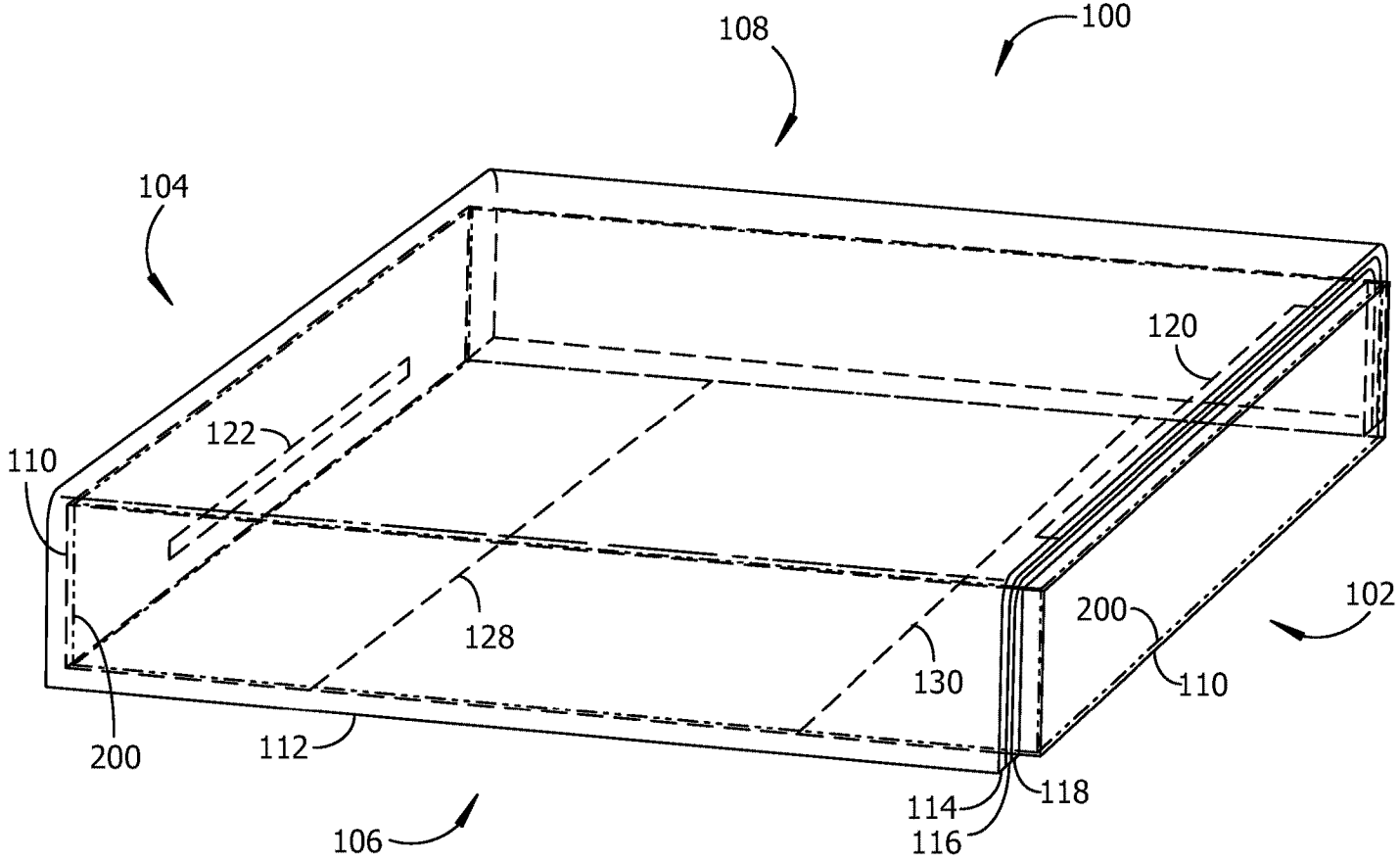
FIG. 1 is a pictorial view toward a top side, right side, and head end of an example of an embodiment.
Figure 2:
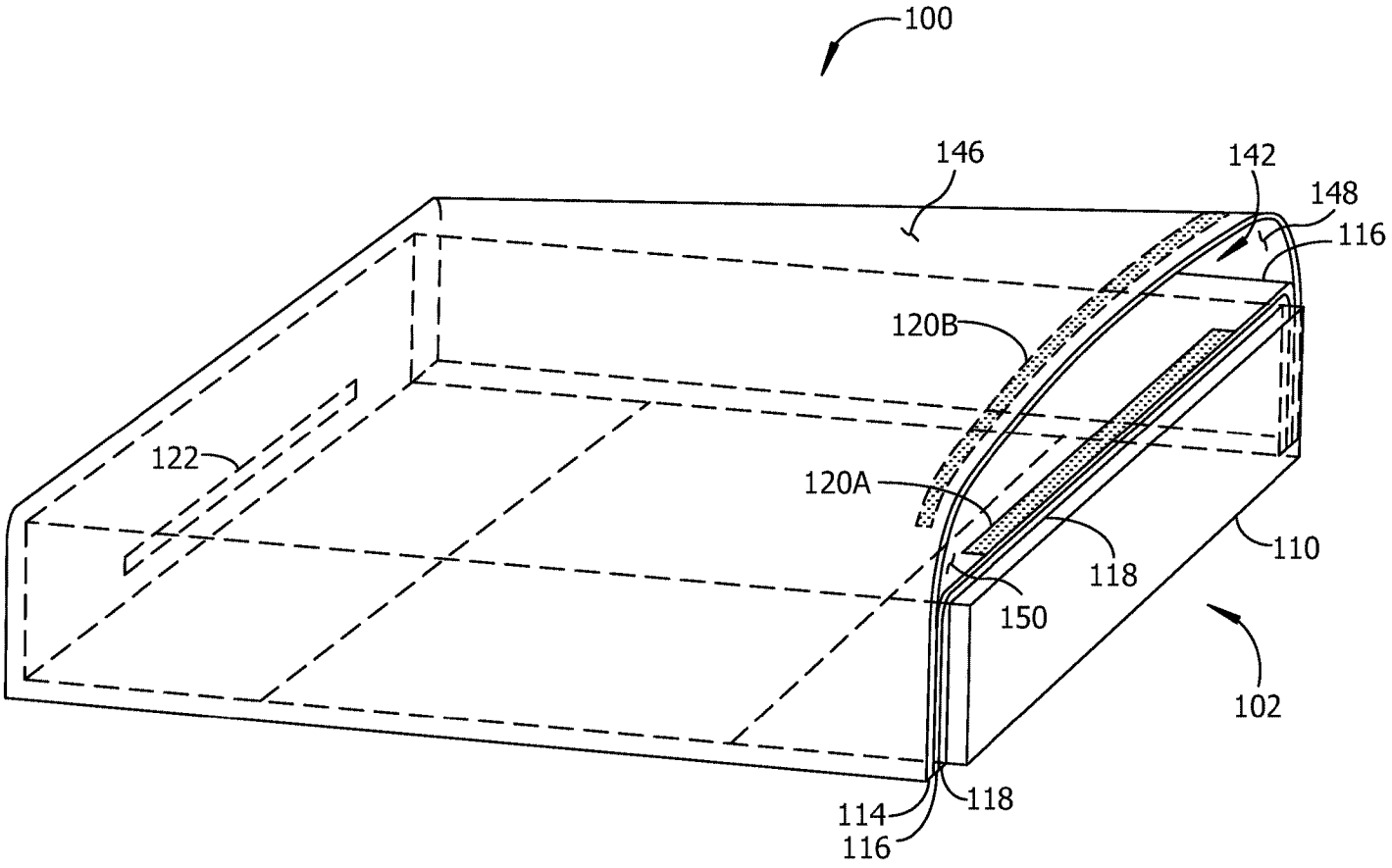
FIG. 2 is a pictorial view of the example of FIG. 1 in which a top cover has been separated from a top sheet assembly near the head end of a top covering assembly to expose a pocket for optional thermal insulation in the top covering assembly.

FIGS. 1 and 2 show an example of an apparatus embodiment installed on a rectangular mattress. The mattress is not part of an embodiment but is illustrated to show relationships between the parts of a unitized bed covering assembly embodiment. In the example of FIGS. 1 and 2, an approximately rectangular mattress 200 is drawn with phantom lines. For discussion purposes herein, directional references are given from the point of view of a person standing at the foot end 104 of the mattress 200, also the foot end of an embodiment 100, facing toward the head end 102 of an embodiment and the head end of the mattress. The right side 106 and left side 108 join the foot end to the head end on the mattress and on an embodiment. A top side of the mattress is the surface upon which a person may sleep. The bottom side of the mattress is opposite the top side.

The mattress 200 fits into pockets formed in a fitted sheet 110 laying on the mattress, one mattress pocket at the foot end and another mattress pocket at the head end. As suggested in FIG. 1 by the edge 128 of the mattress pocket at the foot end 104 and the edge 130 of the mattress pocket at the head end 102, the mattress pockets are preferably wide enough to span a width dimension of the mattress and tall enough to span a thickness dimension of the mattress, with a sliding fit between the ends of the mattress and the mattress pockets and the fitted sheet laying smoothly on the top, sides, and ends of the mattress. A top covering assembly including a top covering and a top sheet assembly attaches strongly to the foot end of the fitted sheet, forming a unitized bed covering assembly embodiment. Installing the fitted sheet onto the mattress also securely installs the top covering assembly. The entire embodiment 100 may be removed from a mattress by removing the fitted sheet from the mattress without separating the other parts of the embodiment from the fitted sheet.

As shown in the example of FIG. 1, the top covering assembly 112 may include at least three separate layers, a fabric top cover 114, a heat-reflecting sheet 116 which may be made from a polymer sheet having a metallic coating capable of reflecting heat energy, for example infrared energy radiated by a person, and a fabric top sheet 118. In some embodiments, the top sheet 118 and the fitted sheet 110 may be made from a same fabric. In an alternative embodiment, the top sheet 118 may be made from a mesh material with at least 40% porosity. Any one or more of the parts of an embodiment may optionally be made from materials that are waterproof and/or stain resistant.

As suggested in FIG. 2, the top cover 114 may be pulled up and away from the heat-reflecting sheet 116 by separating opposing parts of hook-and-loop fastener material 120 (120A, 120B) near the head end 102, exposing a void space between the top surface 150 of the heat-reflecting sheet 116 and the bottom surface 148 of the top cover 114. The void space opens to the outside at the head end and foot end of the top covering assembly 112. The void space corresponds to a pocket 142 in the top covering assembly 112 for holding an optional, additional layer of thermal insulation such as another blanket, felt, quilting material, loose thermal insulation material, and the like. When the pocket 142 is closed by coupling the opposing pieces of hook and loop fastener material (120A, 120B) to one another, the top covering assembly 112 may have the appearance suggested in the example of FIG. 1. More hook and loop fastener material 122 may be provided near the foot end 104 of the top cover assembly 112 and fitted sheet 110 to give access to the pocket 142 from both ends (102, 104) of the embodiment 100.

Figure 3:
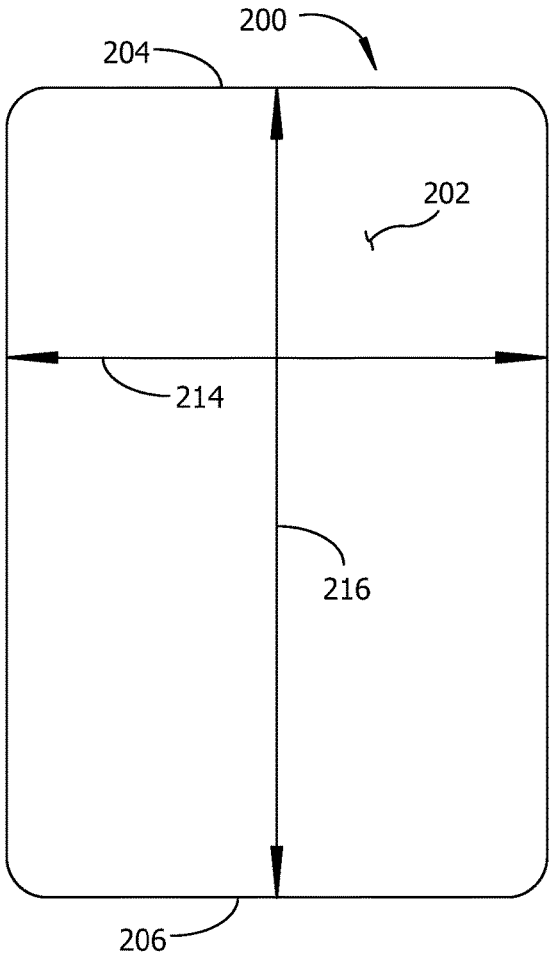
Fig. 3 PRIOR ART
FIG. 3 is view toward the top side of an example of a rectangular mattress. (PRIOR ART)
Figure 4:
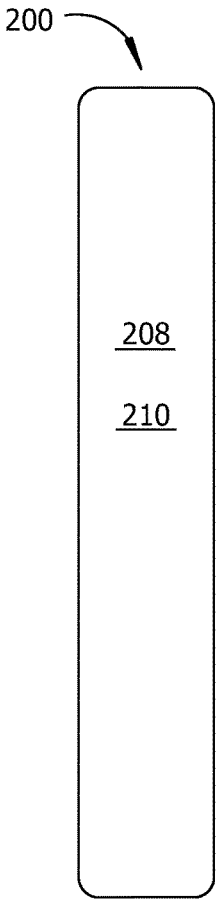
Fig. 4 PRIOR ART
FIG. 4 is a view toward the right side of the example of a mattress from FIG. 3.
Figure 5:
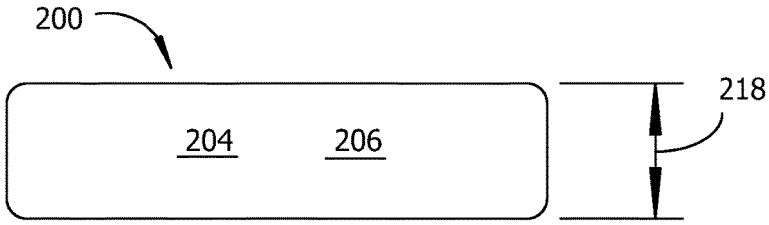
Fig. 5 PRIOR ART
FIG. 5 is a view toward the foot end of the example of a mattress from FIGS. 3-4.

FIGS. 3-5 show examples of a rectangular mattress suitable for use with some embodiments. The mattress 200 is an example mattress on which embodiments described herein may be used. FIG. 3 shows a view toward the top side 202, the top side corresponding to the side upon which a person may sleep. The rectangular mattress 200 has a length dimension 216 extending from a head end 204 to a foot end 206. A width dimension 214 extends transversely across the mattress from a left side to a right side. FIG. 4 shows a view toward a right side 208 of the mattress 200 but is also representative of a view toward a left side 210 of the mattress. FIG. 5 shows a view toward a head end 204 of the mattress 200 but is also representative of a view toward the foot end 206 of the mattress. An example of a thickness dimension of the mattress 218 is marked in FIG. 5. The edges and corners of the rectangular mattress 200 may be rounded as shown in the illustrated examples.

Figure 6:
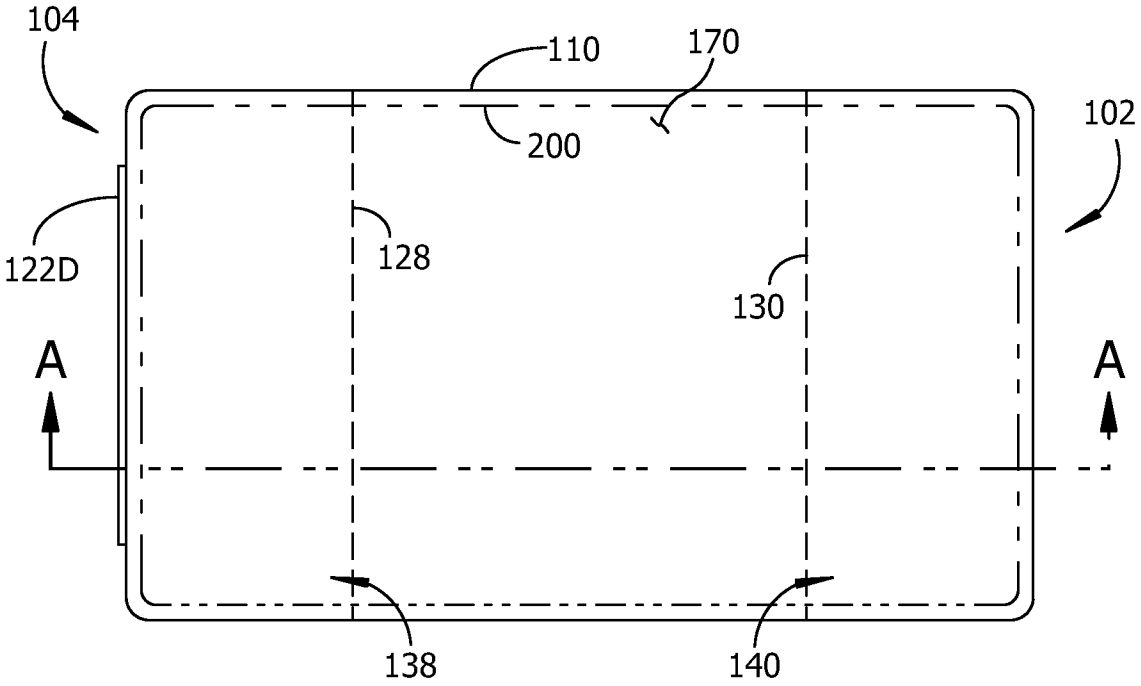
FIG. 6 is a view toward a top side of an example of a fitted sheet in accord with an embodiment, with the fitted sheet dispositioned on an example of a rectangular mattress.

FIGS. 6-9 show an example of the fitted sheet 110 portion of an embodiment installed on an example of a rectangular mattress, with the top covering assembly from a complete embodiment omitted from the views. FIG. 6 is a view toward the top surface 170 of an example of a fitted sheet 110 dispositioned on an example of a rectangular mattress 200 drawn with phantom lines. The fitted sheet 110 is formed with a foot-end mattress pocket 138 opening toward the head end along an edge 128 and a head-end mattress pocket 140 opening toward the foot end along an edge 130. The transverse dimension of the mattress pockets is preferably slightly larger than the width dimension of the mattress 200 to provide for a sliding fit of the ends of the mattress into the mattress pockets. Each mattress pocket may be formed by extending the material of the top surface 170 of the fitted sheet 110 until the material wraps around the foot end and the head end of the mattress and extends along the bottom side of the mattress. The mattress pockets may alternatively be made by joining separate pieces of fabric to the fitted sheet 110.

Leaving a gap between the mattress pocket edges (128, 130) of about half the mattress' length enables the fitted sheet to be installed on the mattress by a slight folding or bending of the mattress ends toward one another. After the mattress ends are inserted into the opposing mattress pockets in the fitted sheet, the mattress may be released to lay flat. Each mattress pocket is long enough that it will not inadvertently slip from the mattress, for example when a person resting on the mattress moves against the fitted sheet, yet is not so long as to interfere with placement or removal of the sheet on the mattress.

Figure 7:
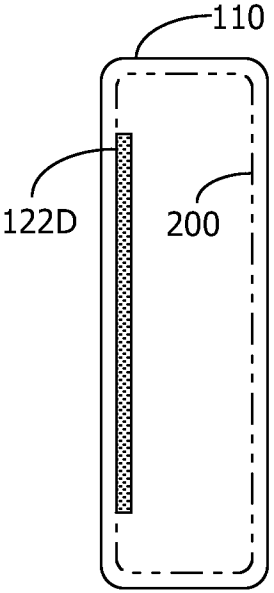
FIG. 7 is a view toward the foot end of the example of the fitted sheet of FIG. 6.

FIGS. 6-7 show a piece of hook and loop fastener material 122D on the foot end of the fitted sheet 110. The hook and loop fastener material may be positioned to engage with a complementary piece of hook and loop fastener material near the foot end of a top covering assembly, thereby joining the fitted sheet to the top covering assembly to form a complete embodiment 100. In alternative embodiments, the hook and loop fastener material may be replaced by other separable fasteners such as, but not limited to, snaps, buttons, a zipper, flexible ties, or may instead be replace by stitching, gluing, or heat fusing to permanently join the top covering assembly to the fitted sheet.

Figure 8:
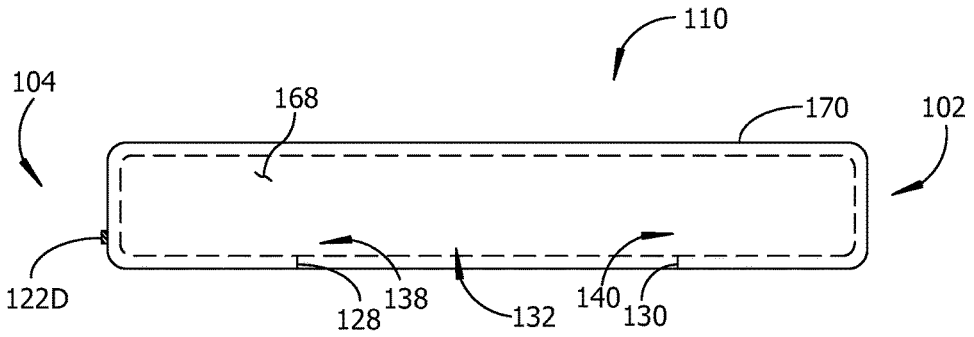
FIG. 8 is a view toward an example of a side panel for the fitted sheet of FIGS. 6-7, for example a first side panel along a right side and a second side panel along a left side of the fitted sheet.

FIG. 8 shows a view toward a side panel 168 of the fitted sheet 110. The example of a side panel 168 in FIG. 8 is representative of both a left side panel and a right side panel for an embodiment adapted for use with a rectangular mattress. The side panels 168 may extend downward along the sides of the mattress to completely conceal the sides of the mattress from view when the bed is made. The side panels 168 may be joined to the end and bottom side of each mattress pocket by stitching, gluing, fusing, or another permanent attachment means. An opening on the first mattress pocket 138 at the foot end 104 of the fitted sheet 110 opposes an opening on the second mattress pocket 140 at the head end 102. An end of a mattress may be slipped into a corresponding mattress pocket through the aperture 132 on the bottom side of the fitted sheet 110.

Figure 9:
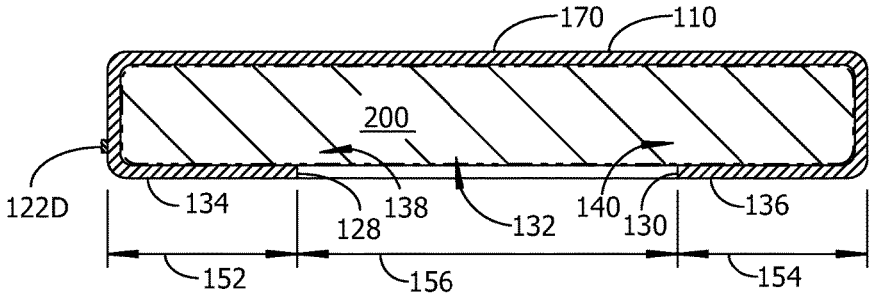
FIG. 9 is a cross-sectional view A-A of the example of a fitted sheet and mattress from FIGS. 6-8. A position and viewing direction for cross-section A-A are marked with a section line A-A in FIG. 6.

FIG. 9 shows some additional details of the example of a fitted sheet from FIGS. 6-8 installed on an example of a rectangular mattress 200. As suggested in FIG. 9, an end of the mattress 200 may slide into the foot-end mattress pocket 138 by passing through the aperture 132 between mattress pockets (138, 140) and into a void space between the bottom side 134 of the foot-end pocket, the foot end 104 of the fitted sheet, and the top side 170 of the fitted sheet 110. The opposite end of the mattress may be placed into a void space between the bottom side 136 of the head-end pocket 140, the head end 102 of the fitted sheet 110, and the top surface 170. The side panels 168 of the fitted mattress preferably extend from the top side to the bottom side of the mattress to conceal the sides of the mattress. The fitted sheet and mattress pockets are preferably sized to fit smoothly around the mattress without wrinkles or surplus fabric. The length 152 of the bottom side 134 of the foot-end mattress pocket 138 may be about one-quarter the overall length of the mattress 200. The length 154 of the bottom side 136 of the head-end mattress pocket 140 may also be about one-quarter the length of the mattress 200. The length 156 of the aperture 132 on the bottom side of the fitted sheet may be about one half the mattress length.

Figure 10:
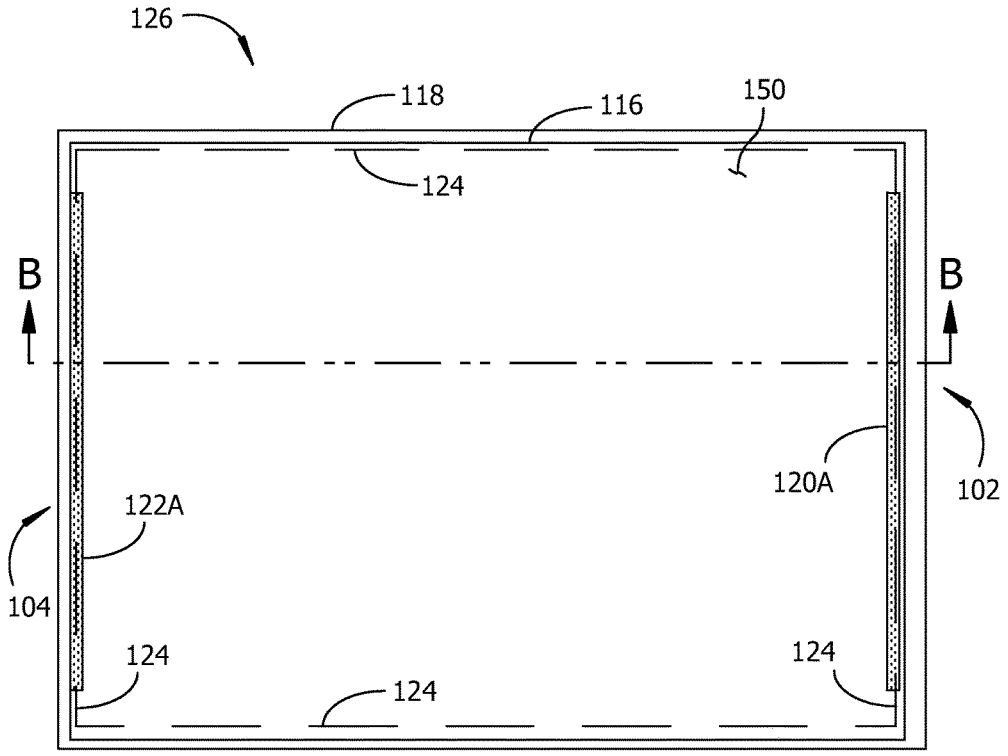
FIG. 10 is a view toward the top side of an example of a top sheet assembly.
Figure 11:
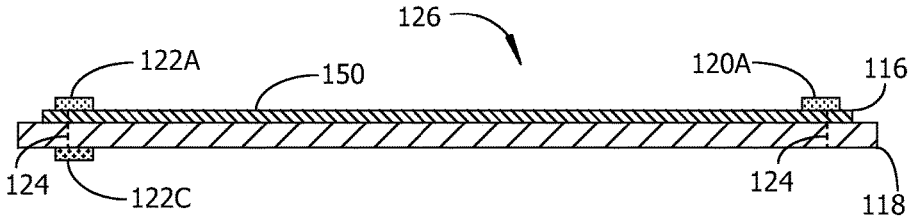
FIG. 11 is a cross-sectional view B-B of the example of a top sheet assembly of FIG. 10. A position and viewing direction for cross-section B-B are marked with a section line B-B in FIG. 10.

FIGS. 10-11 illustrate an example of a top sheet assembly 126 included with some embodiments of a top covering assembly. FIG. 10 shows a view toward a top surface 150 of the heat reflecting sheet 116 from the example of FIG. 1. The heat reflecting sheet 116 may be permanently joined to the top sheet 118 around the outer edges of the heat reflecting sheet, for example along a line of stitching 124. The heat reflecting sheet and top sheet may alternatively be joined by fusing, adhesive, or other permanent attachment means, or may alternatively be joined by separable fasteners such as hook and loop material, snaps, zippers, or buttons. When joined together, the top sheet 118 and the heat reflecting sheet 116 form a top sheet assembly 126.

Figure 13:
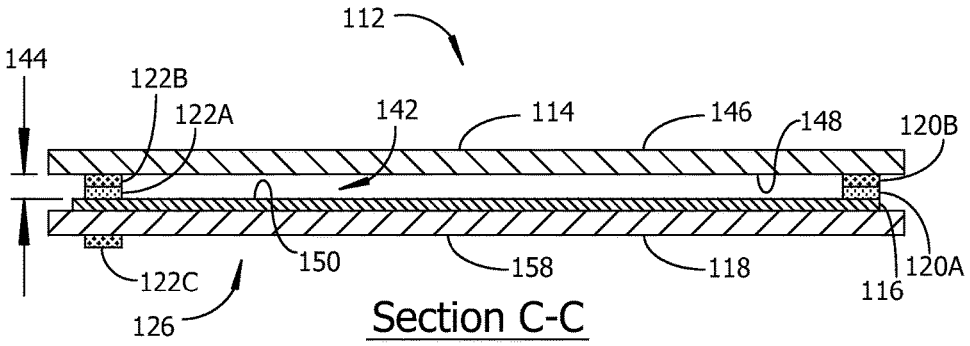
FIG. 13 is a cross-sectional view C-C taken along a length dimension of the example of a top covering assembly from FIG. 12. A position and viewing direction for the cross-section C-C are marked with a section line C-C in FIG. 12.

FIG. 11 shows an example of a cross-sectional view B-B of the top sheet assembly 126 of FIG. 10. The top sheet assembly 126 may include a piece of hook and loop material 122A attached near the foot end of the top surface 150 of the heat reflecting sheet 116 for engagement with a complementary piece of hook and loop fastener material 122B on a bottom side of the top cover 114 (ref. FIG. 13). A piece of hook and loop material 122C near the foot end of the top sheet 118 may be positioned for engagement with a complementary piece of hook and loop material 122D on the fitted sheet 110 (ref. FIGS. 8-9). The top sheet assembly 126 may include another piece of hook and loop material 120A near the head end 102 of the heat reflecting sheet for engagement with a complementary piece of hook and loop fastener material 120B near the head end of the top cover 114.

Figure 12:
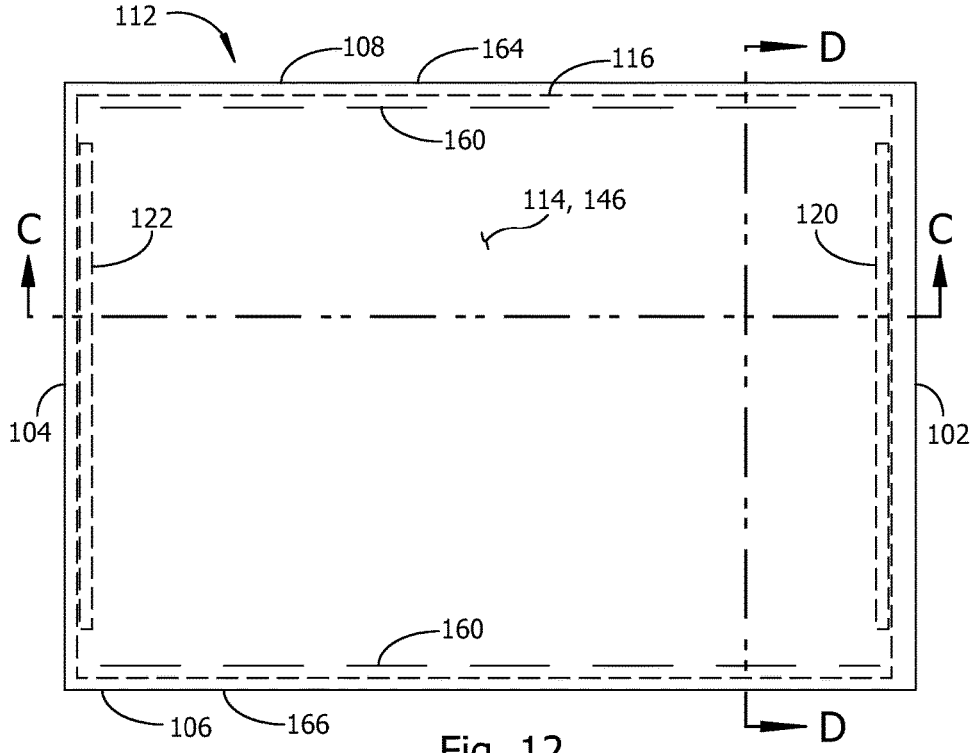
FIG. 12 is a view toward a top surface of an example of a top covering assembly.

Examples of a top covering assembly 112 are shown in FIGS. 12-16. FIG. 12 presents a view toward a top surface 146 of the top cover 114, the topmost layer of the top covering assembly 112. FIG. 13 shows a cross-sectional view C-C taken from the head end 102 to the foot end 104 of the top covering assembly 112. The top covering assembly 112 may be strongly joined to the top sheet assembly 126 by an attachment means 160 near the edge 164 of the left side 108 and by another attachment means 160 near the edge 166 of the right side 106. Examples of the attachment means 160 include, but are not limited to, permanent means such as stitching, adhesive, or heat fusing, or by separable means such as snaps, zippers, buttons, or hook and loop fastener material. In a preferred embodiment, the top cover 114 is joined to the top sheet assembly 126 by stitching.

Figure 14:
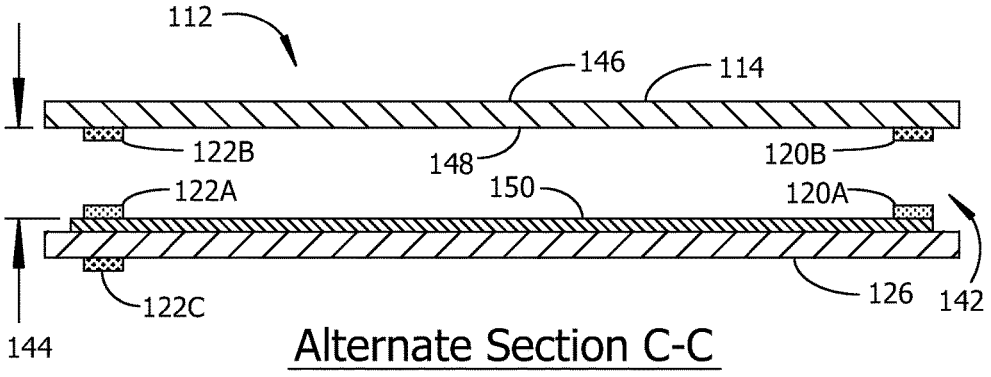
FIG. 14 is an alternate cross-sectional view C-C in which the top cover has been separated from the top sheet assembly at the head end and at the foot end of the top covering assembly to open a pocket in the top covering assembly.
Figure 15:
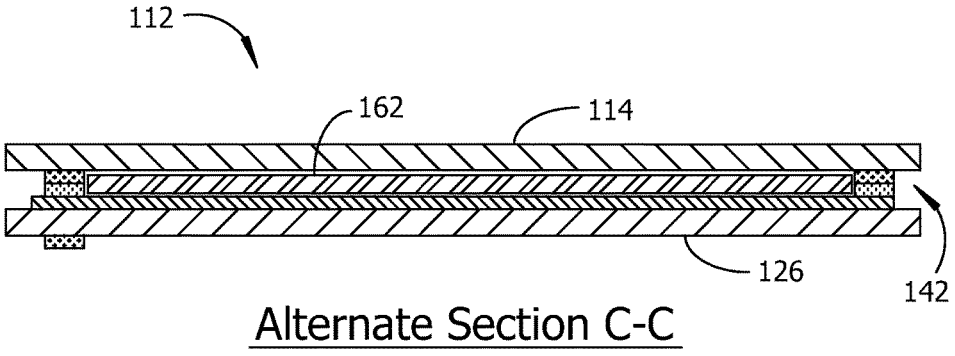
FIG. 15 is an alternate cross-sectional view C-C in which an optional layer of a thermal insulator has been dispositioned between the top cover and the top sheet assembly from the example of a top covering assembly of FIGS. 12-14, and further showing the pocket in the top covering assembly closed at the head end and foot end.

When the top cover 114 is joined to the top sheet assembly 126 by attachment means 160, separable fasteners 122 near the foot end 104, and separable fasteners 120 near the head end 102, a pocket 142 for optional thermal insulation may be formed by the void space 144 between the bottom surface 148 of the top cover 114 and the top surface 150 of the heat-reflecting sheet 116. The top covering assembly 112 may be coupled to the fitted sheet (ref. FIG. 1) with the bottom surface 158 of the top sheet 118 in contact with the fitted sheet 110. The top cover may be opened at the foot end and head end to access the pocket as shown in FIG. 14. A layer of optional thermal insulation 162 may be inserted into the pocket 142 and the pocket re-closed as suggested in FIG. 15.

Figure 16:
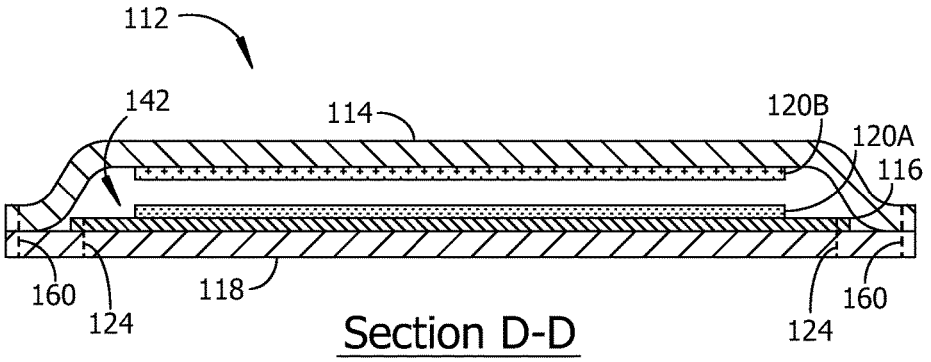
FIG. 16 is a cross-sectional view D-D taken along a width dimension of the example of a top covering assembly from FIG. 12, showing an example of the top covering separated from the top sheet assembly to open the pocket from the head end. A position and viewing direction for the transverse cross-section D-D are marked with a section line D-D in FIG. 12.

FIG. 16 illustrates an example of a cross-sectional view D-D taken transversely across the top covering assembly 112. In the example of FIG. 16, opposing pieces of hook and loop fastener material (120A, 120B) have been separated from one another to open the pocket at the head end of the top covering assembly, exposing the heat-reflecting sheet 116 inside the pocket. In the example of FIG. 16, separate lines of stitching join the heat-reflecting sheet 116 to the top sheet 118 (ref. stitching 124) and the top cover 114 to the top sheet 118 (ref. stitching 160). In an alternative embodiment, the top cover, heat-reflecting sheet, and top sheet may be joined to one another along the left and right sides of an embodiment by a single line of stitching near each side.

Figure 17:
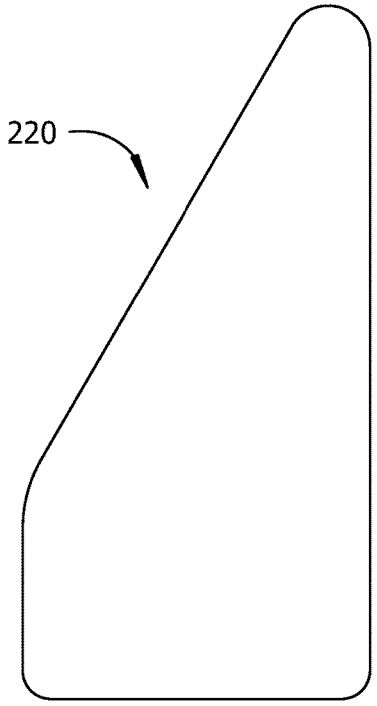
Fig. 17 PRIOR ART
FIG. 17 is a view toward the top surface of an example of a non-rectangular cushion. (PRIOR ART)
Figure 18:
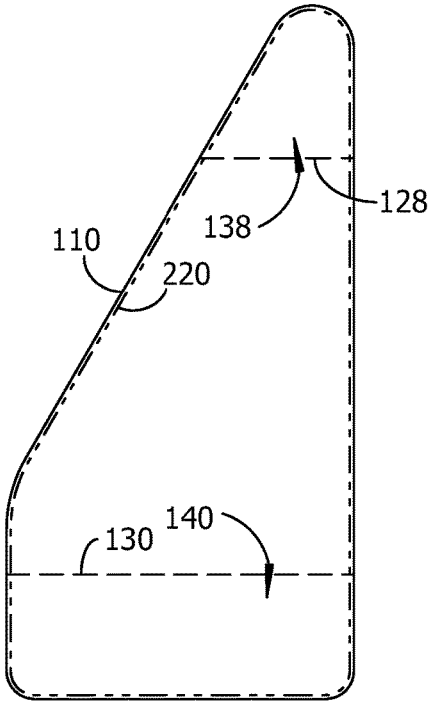
FIG. 18 is an example of a fitted sheet in accord with an embodiment installed on the example of a non-rectangular cushion of FIG. 17.
Figure 19:
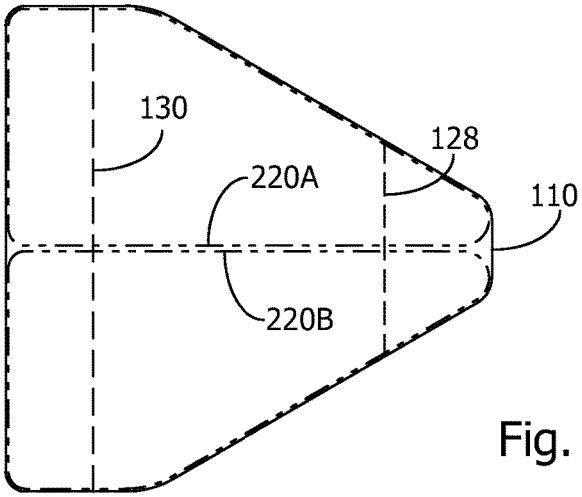
FIG. 19 is another example of a fitted sheet in accord with an embodiment installed on two non-rectangular cushions placed adjacent one another in the head-end pocket and foot-end pocket of the fitted sheet.

Unlike elasticized fitted sheets, embodiments are well suited for use with beds that have non-rectangular mattresses. For example, the example of a known mattress 220 in FIG. 17 has a nonrectangular perimeter shape. Such mattresses may be used in the V-berth of a boat or other places where a bed changes in width from head end to foot end. Sheets with elasticized corners may be difficult to secure flat and unwrinkled against a non-rectangular mattress. Unlike fitted sheets, embodiments of a fitted sheet with mattress pockets are easily adapted to fit securely and smoothly against nonrectangular mattresses, as suggested in FIGS. 18-19. In the example of FIG. 18, a foot-end mattress pocket 138 has a different shape than a head-end mattress pocket 140. In the example of FIG. 19, a single fitted sheet 110 holds two adjacent nonrectangular mattresses (220A, 220B) closely and securely together.

Figure 20:
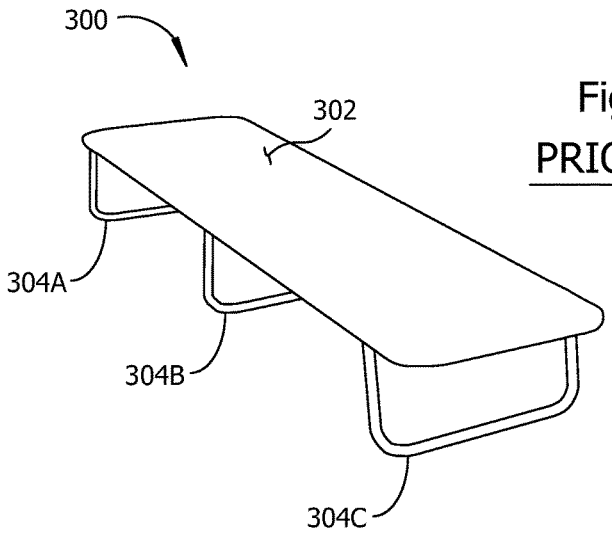
Fig. 20 PRIOR ART
FIG. 20 is a pictorial view of an example of a folding camping cot. (PRIOR ART)
Figure 21:
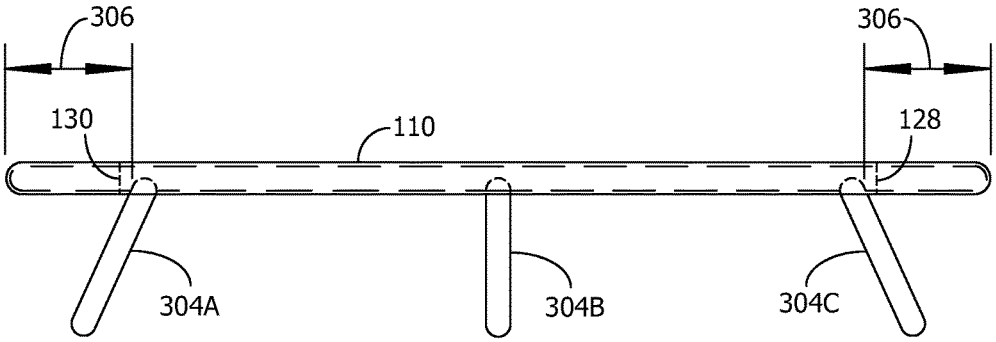
FIG. 21 is a side view of an example of a fitted sheet portion of an embodiment installed on the example of a camping cot from FIG. 20.

Conventional bedding is difficult to arrange securely and neatly on beds that have either a thin mattress or no mattress at all. FIGS. 20-21 show views of an example of a known folding camping cot 300 having legs 304A, 304B, 304C coupled to a rigid frame, over which a flexible fabric may be stretched to form a sleeping surface 302. On some camping cots 300, the head end and foot end of the cot may be cantilevered 306 beyond the legs (304A, 304C), making it difficult to secure conventional sheets and blankets to the bed with a neat appearance. The upper frame of the camping cot may be too thin to be gripped securely by a fitted sheet with elasticized corners, and the sheet and other bedding may be easily disarranged. In contrast to conventional bedding, the mattress pockets in a fitted sheet 110 in accord with an embodiment are held neatly and securely by the cantilevered section of the sleeping surface 302, as shown in FIG. 21. A top covering assembly (not shown in FIG. 21) may be attached to the fitted sheet 110 as described above for other embodiments of a unitized bed covering assembly.

Unless expressly stated otherwise herein, ordinary terms have their corresponding ordinary meanings within the respective contexts of their presentations, and ordinary terms of art have their corresponding regular meanings.

What is claimed is:

1. An apparatus, comprising:

a fitted sheet comprising a first mattress pocket at a foot end and a second mattress pocket at a head end;

a top covering assembly detachably coupled to said fitted sheet near said foot end of said fitted sheet, said top covering assembly comprising:

a top sheet assembly comprising:

a top sheet; and a heat-reflecting sheet made from a polymer sheet with a metallic coating, said heat reflecting sheet fixed to said top sheet by a first line of stitching passing through said heat reflecting sheet and said top sheet along a left side, a foot end, a right side, and a head end of said heat reflecting sheet;

a top cover joined to said top sheet assembly by a second line of stitching along a right side of said top cover and a third line of stitching along a left side of said top cover, a bottom side of said top cover adjacent a top side of said heat-reflecting sheet, a pocket for receiving thermal insulation extending from said bottom side of said top cover to said top side of said heat-reflecting sheet and from a foot end of said top covering assembly to a head end of said top covering assembly;

a first separable fastener having a first part attached to said foot end of said heat reflecting sheet and a second part attached to a foot end of said top cover;

a second separable fastener having a first part attached to said head end of said heat reflecting sheet and a second part attached to a head end of said top cover;

a third separable fastener having a first part attached to said foot end of said fitted sheet and a second part attached to said foot end of said top covering assembly; and a layer of thermal insulation inserted in said pocket;

wherein:

said first line of stitching does not pass through said top cover;

neither said second line of stitching nor said third line of stitching passes through said heat-reflecting sheet;

said pocket for receiving thermal insulation opens at said foot end of said top covering assembly when said first part and said second part of said first separable fastener are detached from one another;

said pocket for receiving thermal insulation opens at said head end of said top covering assembly when said first part and said second part of said second separable fastener are detached from one another; and Said pocket holds said layer of thermal insulation without direct attachment of said layer to said top covering assembly.

2. The apparatus of claim 1, wherein said first mattress pocket is shaped for a sliding fit over a foot end of a mattress.

3. The apparatus of claim 1, wherein said second mattress pocket is shaped for a sliding fit over a head end of a mattress.

4. The apparatus of claim 3, wherein said first mattress pocket and said second mattress pocket are formed for a sliding fit over opposite ends of a nonrectangular mattress.

5. The apparatus of claim 3, wherein said first mattress pocket and said second mattress pocket are formed for a sliding fit over opposite overhanging ends of a camping cot.

6. The apparatus of claim 1, wherein said first separable fastener comprises opposing pieces of a hook-and-loop material.

7. The apparatus of claim 1, wherein said second separable fastener comprises opposing pieces of a hook-and-loop material.

8. The apparatus of claim 1, wherein said first mattress pocket is shaped to extend along a bottom side of a mattress approximately one-quarter of a length dimension of the mattress.

9. The apparatus of claim 1, wherein said second mattress pocket is shaped to extend along a bottom side of a mattress approximately one-quarter of a length dimension of the mattress.

10. The apparatus of claim 1, wherein said first mattress pocket and said second mattress pocket are separated from one another by an aperture extending across a width dimension of a mattress.

11. The apparatus of claim 1, wherein said top sheet and said fitted sheet are made from a same fabric.

* * * * *